US007827621B2

(12) United States Patent
DaCruz

(10) Patent No.: US 7,827,621 B2
(45) Date of Patent: Nov. 9, 2010

(54) HAIR DRYING CAP

(75) Inventor: Amelia DaCruz, 1157 Paramore Dr., Virginia Beach, VA (US) 23454

(73) Assignee: Amelia DaCruz, VA Beach, VA (US)

( * ) Notice: Subject to any disclaimer, the term of this patent is extended or adjusted under 35 U.S.C. 154(b) by 124 days.

(21) Appl. No.: 11/716,604

(22) Filed: Mar. 12, 2007

(65) Prior Publication Data

US 2008/0222775 A1 Sep. 18, 2008

(51) Int. Cl.
*A42B 1/00* (2006.01)

(52) U.S. Cl. ..... 2/174; 2/204; 2/207; 2/410; 2/10; 2/184.5; 2/202; 2/203; 2/208; 2/195.8; 132/273; 132/274; 132/212; 132/222; D2/865; D2/867; D2/889; D2/895

(58) Field of Classification Search ..... 2/174, 2/204, 207, 172, 410, 10, 184.5, 202, 203, 2/208, 195.8; 132/274, 273, 222, 212; D2/865, D2/867, 889, 895
See application file for complete search history.

(56) References Cited

U.S. PATENT DOCUMENTS 1,624,727 A * 4/1927 Goldberg ..... 2/209.5
2,685,091 A * 8/1954 Thill ..... 2/204
D200,758 S * 4/1965 Couffer ..... D2/877
D205,180 S * 7/1966 Davis et al. ..... D2/875
3,636,962 A * 1/1972 Frackowiak ..... 132/60
5,062,157 A * 11/1991 Muta ..... 2/171
5,170,509 A * 12/1992 Leopold ..... 2/195.1
D390,340 S * 2/1998 Najim ..... D2/866
5,878,756 A * 3/1999 Bilodeau ..... 132/274
5,933,872 A * 8/1999 Lema ..... 2/209.7
6,023,788 A * 2/2000 McCallum et al. ..... 2/209.13
6,401,255 B1 * 6/2002 Douglas ..... 2/207
D501,281 S * 1/2005 Kole ..... D29/122
2004/0006809 A1 * 1/2004 Crenshaw et al. ..... 2/209.3

* cited by examiner

*Primary Examiner*—Gary L Welch
*Assistant Examiner*—Alissa J Tompkins

(57) ABSTRACT

A hair drying head-piece that absorbs moisture from the hair of a wearer, said headpiece having a cap portion having a top part and a bottom part, said cap bottom part having an opening sized to fit about the top of the wearer's head and said cap top part having a hole therein to allow at least a portion of the wearers's hair to exit the cap therethrough; and at least 4 flat water-absorbing fabric strips attached to the cap top part, each of the 4 flat water-absorbing fabric strips having a length of between 12 and 30 inches and a width between 0.6 inches and 2 inches, wherein said strips fall freely with the wearer's hair.

17 Claims, 6 Drawing Sheets

HAIR DRYING CAP

FIELD OF THE INVENTION

This invention relates to hair drying garments that absorb and evaporate moisture from a person's hair. More particularly, the present invention is directed to a hair drying cap that absorbs moisture from the hair of the wearer by use of absorbent material formed as long strips of fabric and/or tassels, hanging from a cap, that can advantageously be woven through the hair, where at least a portion of the tassels or ribbons draw the moisture from the hair into the multiplicity of randomly arranged fibers of which the material is made greatly increasing the relative surface area exposed to the moisture.

BACKGROUND OF THE INVENTION

Hair drying caps are generally known. The simplest hair drying device is a towel wrapped around the head. A close variant of that can be found in U.S. Pat. No. 5,249,308, which describes an after shower hat that is fabricated from a towel-like material. A rectangular piece of the material is folded in half. The open sides are sewn forming first and second seams, and elastic is sewn around the opening to provide a snug fit. The seams are also provided with a stiffening material, whereby when the hat is worn with the seams at the front and back of the head, the stiffening material in the walls causes the hat to stand relatively straight out from the wearer's head. This permits the hair to dry within the confines of the enclosed space without flattening. Another close variant can be found in U.S. Pat. No. 5,365,613, which describes a hair drying turban made from a single piece of absorbent cloth and having a cap portion and, extending forwardly, a hair basket portion. In use, the wearer places the cap portion on his or her hair with the hair extending forwardly over the forehead and face. Then, with the hair placed neatly within the hair basket portion, the hair basket is twisted about the longitudinal axis of the hair. The hair basket portion is then folded backwardly along the center line of the cap portion and secured to the back of the cap portion. A loop is provided to facilitate the tucking in of the hair basket portion beneath the cap portion.

A number of hair drying caps incorporate an absorbing or desiccating material sandwiched between layers. U.S. Pat. No. 4,542,595 describes a hair drying cap that rapidly absorbs moisture from the hair of the wearer by use of multiple layers of a unique absorbent material that draws the moisture from the hair into the multiplicity of randomly arranged fibers of which the material is made. The randomly arranged fibers are disposed between the inside layer and the outside layer of at least sections of a cap.

Caps used for athletic endeavors are also generally known. U.S. Pat. No. 5,878,756 describes a hair tie having an elongated tubular hair sleeve constructed from a flexible material for encompassing hair of a user. The elongated tube is in the form of a sheet hanging down from a cap, said sheet having securement mechanisms (ties) situated along a length of the sleeve to form the sheet into a bundle about the wearer's hair. The wearer's hair is contained within the elongated tube which extends downward from the back of the cap.

All of the above suffer from a number of deficiencies. First, they all enclose the hair, preventing air from circulating about the hair. Second, the enclosing drying fabrics flatten the hair, or allow the hair to merely sit inside a tent-like enclosure, without any possibility of shaping the hair. Third, the look of any of the above will discourage a user from wearing the same in public. This invention resolves all these problems.

SUMMARY OF THE INVENTION

It is an object of the present invention to provide an improved after-shower or after-swim cap for drying hair without causing the hair to become flattened or twisted. It is a further object of the present invention to provide an improved after-shower cap which may be worn on heads of different sizes and accommodate varying lengths of hair, and especially long hair. It is yet another object of the present invention to provide an improved after-shower cap which may be easily and efficiently manufactured and marketed. It is yet another object of the invention to provide a fashionable head-piece.

The invention is a hair drying head-piece that combines ease of use, efficiency, ability to mold or curl hair, and further is a fashionable head-piece. The head-piece comprises a cap adapted to fit about the head of the wearer, and a plurality of water-absorbing long fabric strips and/or tassels attached on at least one end to the cap and extending downward from the cap. The cap portion is adapted to fit about the wearer'r head. The cap therefore forms a circle on the bottom part, and can advantageously include an elastic band along the bottom part to secure the fit, as is known in the art. The upper part of the cap may be open or closed. If the upper part of the cap is open, so that hair can come out through the top of the cap, the cap may resemble a cylinder or a tapered cylinder. If the upper part of the cap is closed, the cap can be in a shape of a pinched-down cylinder (as would be obtained by simply sewing shut a fabric cylinder with a stitch disposed perpendicular to the axis of the cylinder that joins the sides of the cylinder) or can be tapered to resemble a hemispherical configuration, for example resembling a ski cap. An open cap or a pinched-down cylinder shape is preferred.

A plurality of water-absorbing strips of fabric or water-absorbing tassels are attached to the cap. Water-absorbing strips of fabric are preferred, but both strips and tassels can be used to provide an ornamental look. There are at least 3, preferably at least 4, for example between 5 and 8, between 9 and 12, or between 13 and 16 water-absorbing strips of fabric or water-absorbing tassel attached to the headpiece.

In preferred embodiments three or more, preferably four or more, of the water-absorbing strips of fabric or tassels have a length of at least 8 inches, preferably at least 10 inches, for example between 12 and 30 inches, or between 14 and 24 inches, such that they can be woven through hair. Different strips of fabric or tassels can have different lengths to provide an ornamental look. The water-absorbing strips of fabric have a width of at least 0.4 inches, preferably at least 0.6 inches, more preferably at least 0.8 inches, but the width of the strips should not exceed 2.5 inches, preferably should not exceed 2 inches, and more preferably should not 1.5 inch. If the strips are too wide they will not be readily woven together, woven through the hair, wrapped about the wearer's neck or body, freely hang, or any combination of the above. Most preferably, a least 3, preferably at least 4, more preferably at least 5 of the ribbons have a width between 0.75 inches and 1.25 inches and have a length between 14 inches and 22 inches. The strips can be tapered by a small amount, but advantageously the strips are fairly straight, with the opposite edges of the strip being substantially parallel one to another so that the strip width at a point 8 inches from where the strip abuts the cap is within a half an inch, preferably within a quarter of an inch, of the strip width where the strip abuts the cap. Alternatively the opposite edges of the flat water-absorbing fabric strips are substantially parallel one to another so that the strip width at a point 8 inches from where the strip abuts the cap is within a half an inch of the strip width at a point 1 inch from where the strip abuts the cap. This will provide the largest amount of evaporation near the end of the wearer's long hair, where it is needed most as gravity will result in water migration down the hair. It is impractical to have the width of strips increase with length away from the cap, and such strips would interfere with the wearability and fashionable aspects of the head-piece. Of course, the last few inches of a strip (when measured away from the cap) can be tapered down without unduly sacrificing the drying function of the headpiece, but such a taper would be for ornamental purposes.

While some of the strips may be for example sliced lengthwise and then be braided into one or more tassels, or may be sewn together at each end to form a tube, flexible flat strips are preferred as they can more readily lay against hair extending below the cap, and can more quickly absorb water from hair and facilitate the evaporation of that water. Additionally, the drying function of the head-piece is reduced considerably is the tubes or braids have sufficient structural integrity such that they are directed even a small degree away from the wearer's body, as the strips must contact the hair to perform the drying function. Advantageously at least the majority of the strips are flat, having a prescribed length and width, and having very little stiffness.

The water-absorbing strips of fabric or tassels can be attached to the top part of the cap, to the bottom part of the cap, or to both. Preferably the cap has an open top part or a pinched down cylinder-shaped top and at least 3, preferably at least 4, more preferably at least 5 of the water-absorbing long fabric strips and/or tassels are integral with the cap, that is, formed from a single piece of fabric. The strips or tassels preferably do not spring from the top center of a cap (as for example an ornamental ball might be centered on the top center of a ski cap), but rather in a most preferred embodiment, the top part of the cap folds down toward the back or side of the wearer's head and the at least 3, preferably at least 4, more preferably at least 5 of the water-absorbing long fabric strips and/or tassels extend from the top of the cap and are integral with the top portion of the cap (that is, formed from the a single piece of fabric that is continuous with the cap portion).

In use, the wearer places the cap portion on the head, such that the water-absorbing strips of fabric and/or tassels are hanging along the side of the face, along the back of the face, or both. It will be evident that the cap fits snugly over the head of a wearer bringing the fabric into direct contact with the wearer's hair. The inner surface or layer of material engages the wearer's hair absorbing the moisture therefrom and conversely giving up the moisture to the outer surface or layer of fabric. This capillary action between the fabric layers of material speeds the drying of the hair so that in a short time a substantial quantity of water can be removed. Strips of the water-absorbing strips of fabric and/or tassels can be interwoven through the hair, thus shaping the hair.

Advantageously there is a small pocket disposed within the cap portion which can be used to hold small personal items such as a key or driver's license. In more preferred embodiments, the pocket has a seal, such as Velcro® or a zipper, to keep items from falling out of the pocket. Advantageously the pocket is slim and can not be seen when the head-piece is being worn.

LIST OF FIGURES

DESCRIPTION OF PREFERRED EMBODIMENTS

Figure 1:
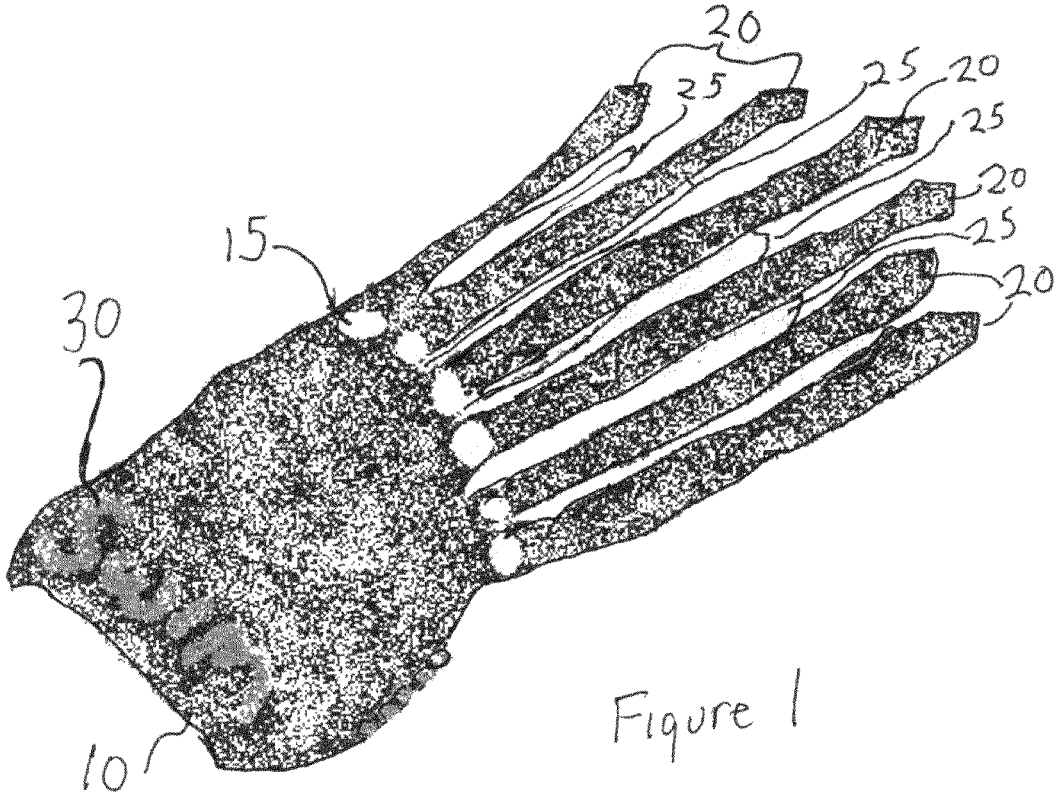
FIG. 1 is a drawing of an embodiment of the head-piece, where the strips of fabric are as short as practicable

The head-piece has a number of ornamental features which also can have a function. In one embodiment the water-absorbing long fabric strips have two separate sides, where a first side is visually distinguishable from a second side. This allows the display of a number of colors and/or fabrics. For use by a swim team for identification or affiliation purposes, for example, strips may be formed from two pieces of fabric which are sewed together, where the two fabrics are separate colors. As shown in the drawings, one side of the strips may have a sequined fabric sewn thereon. There may be on a single head-piece a combination of long strips of fabric of varying length, color, texture, width, or any combination thereof. There may be a combination of these long strips with tassels. A number of the long strips of fabric, but preferably not all of the long strips of fabric, may be sewn into tubes, or cut very finely and then be braided.

The head-piece has a clear front surface and/or side surfaces of the cap portion for ready display of logos and such.

The absorbent material is advantageously a water-absorbing fabric such as terry-cloth, felt, a microfiber or the like.

In one advantageous combination, the headpiece is formed from two or more pieces of fabric that joined to one another by overlapping the same and sewing or by glue or by stitching as will be understood by those skilled in the art. This joined fabric is then formed into a cylinder which is subsequently cut and formed into an integral head-piece having the cap portion and the long strips of fabric. In one embodiment the interior fabric can be a simple transmitting fabric, such as woven rayon, while the exterior fabric can be a water-absorbing fabric. In another embodiment the elastic band can be disposed between layers. In another embodiment the cap portion of the fabric may contain a reinforcing sheet of fabric.

Figure 2:
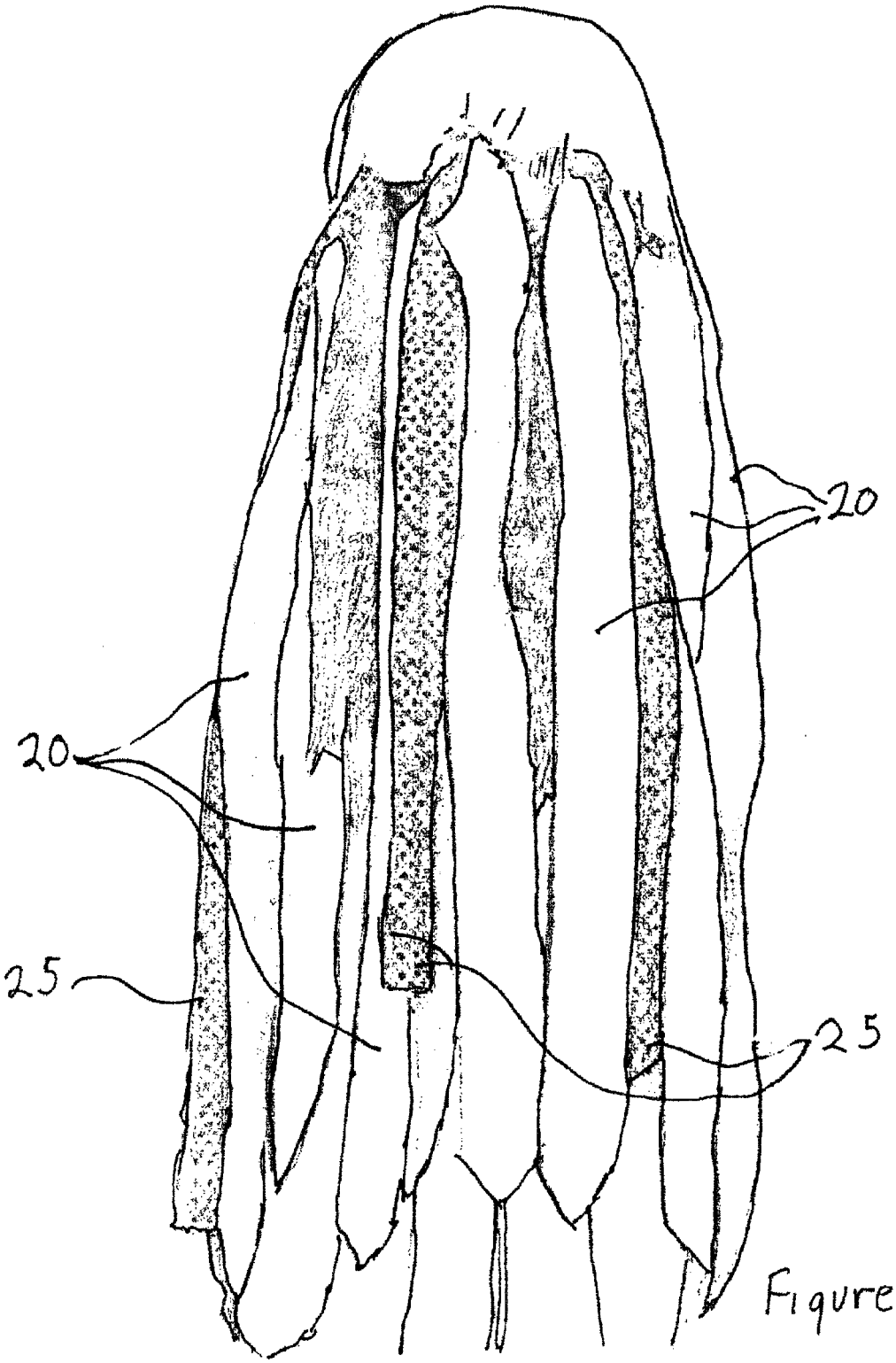
FIG. 2 is a rear perspective of the head-piece being worn.
Figure 3:
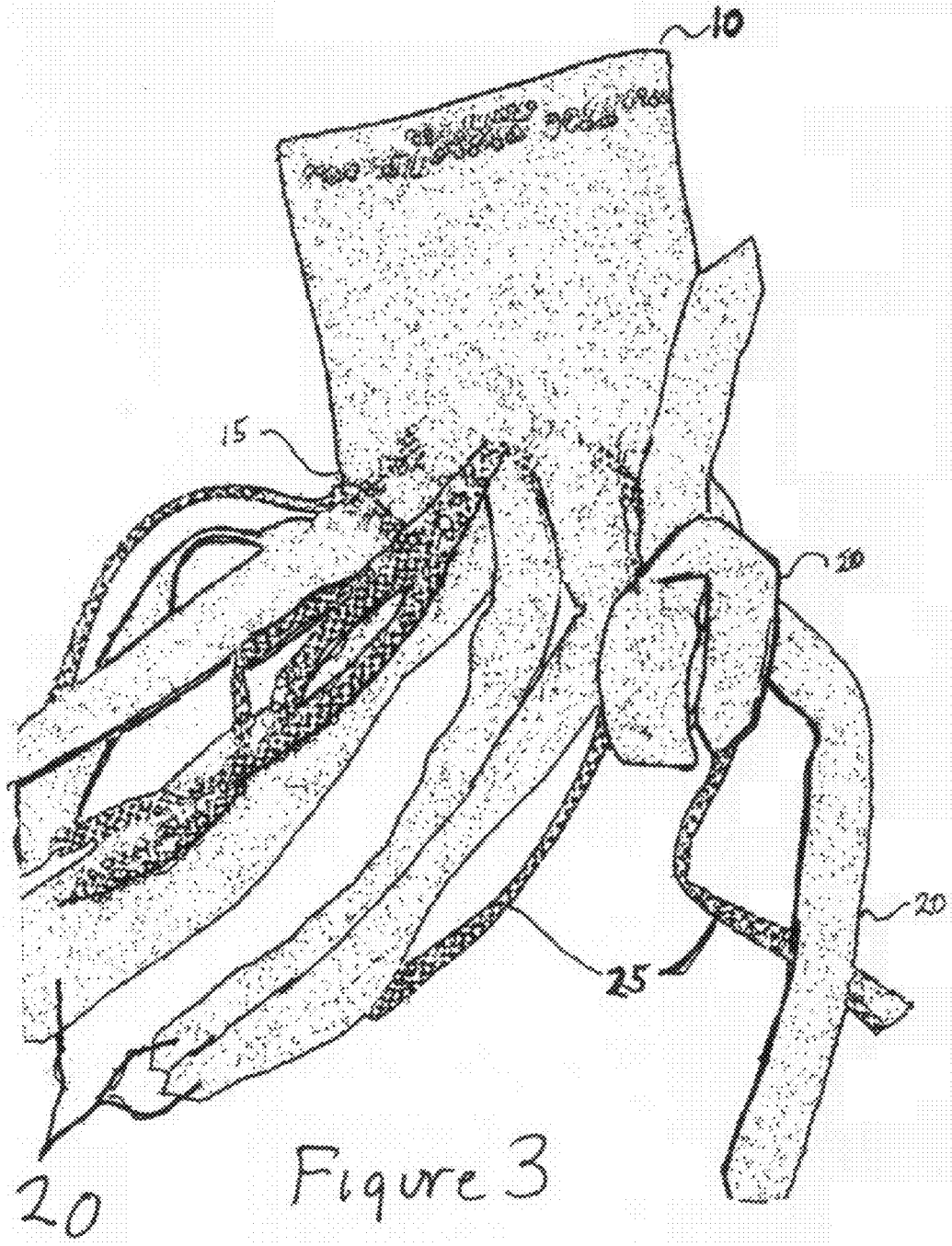
FIG. 3 is a perspective of the head-piece.
Figure 4:
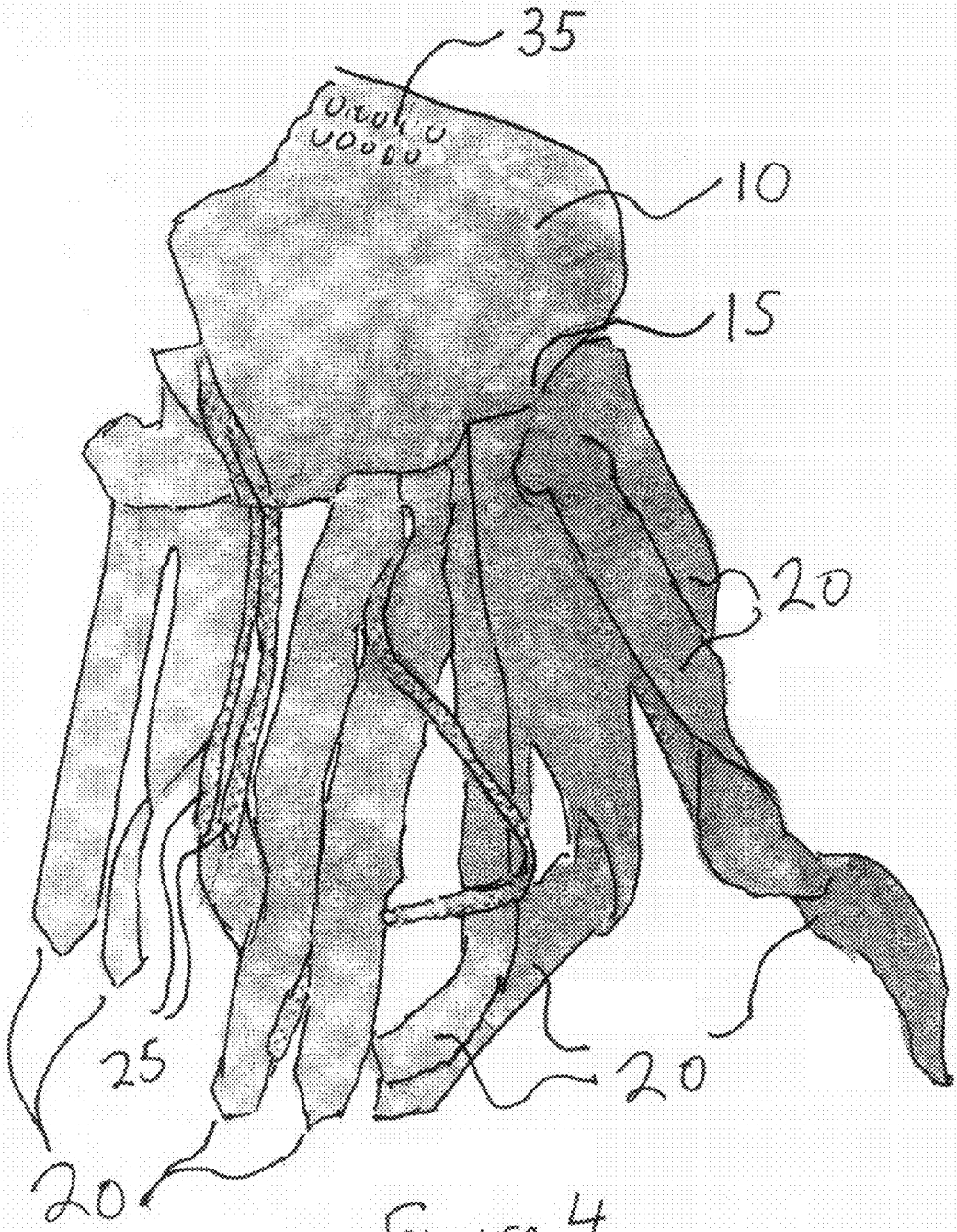
FIG. 4 is a perspective of the head-piece.
Figure 5:
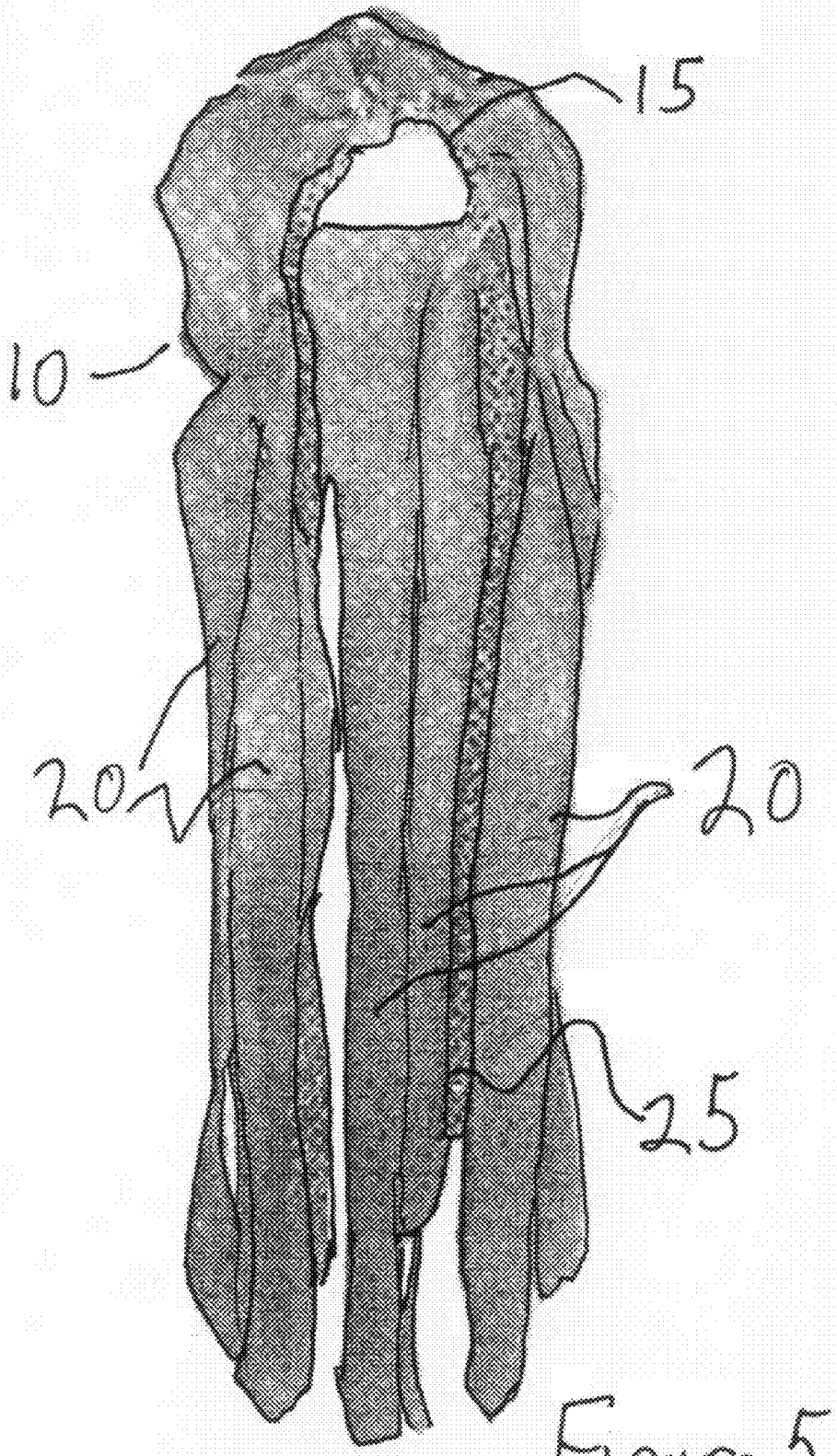
FIG. 5 is a perspective of the head-piece.
Figure 6:
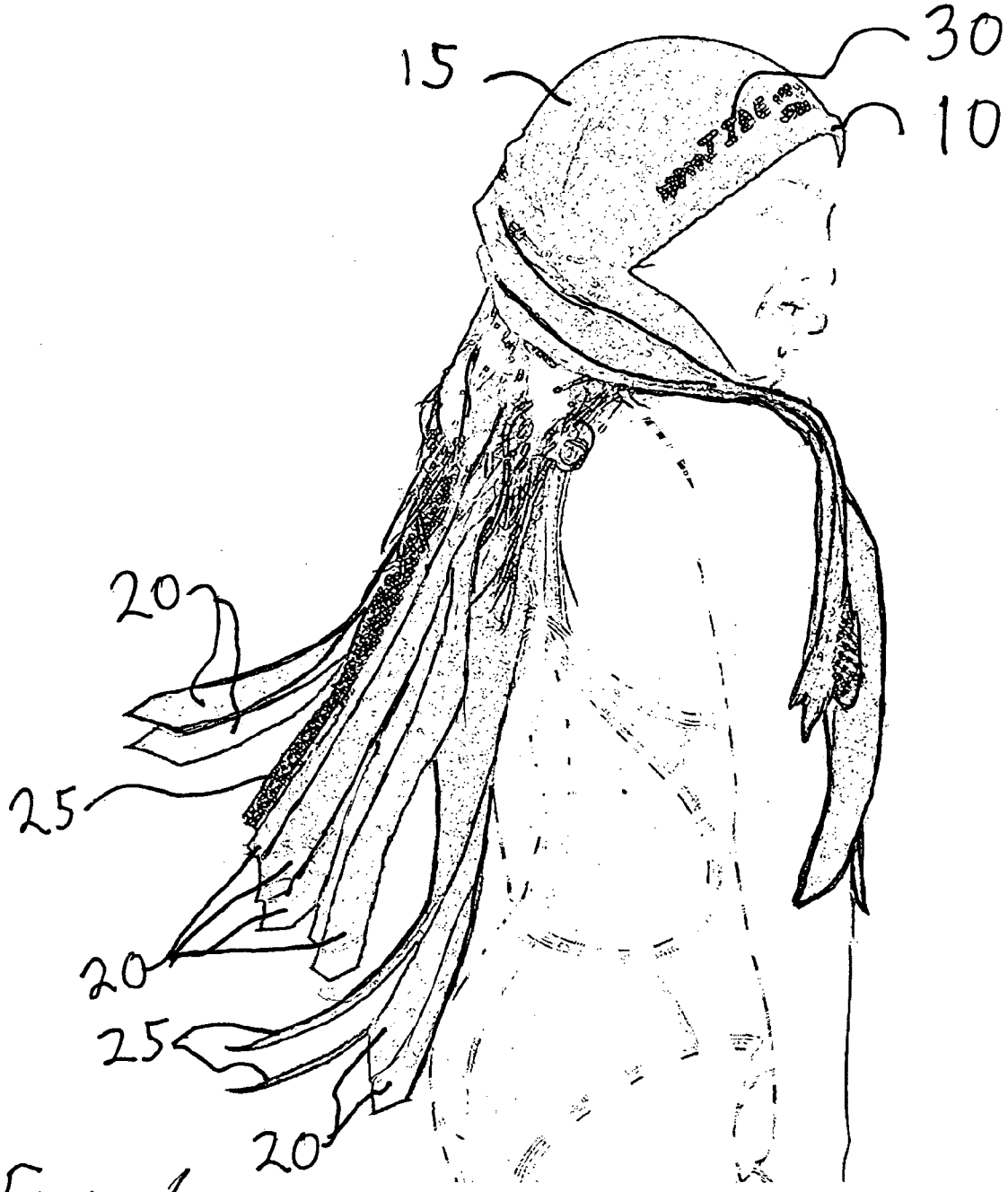
FIG. 6 is a perspective of the head-piece.

Referring now to FIGS. 1 to 6 of the drawings, the lower part of the cap is shown by numeral (10). the upper part of the cap is shown by numeral (15), each of a plurality of long strips of fabric are shown by numeral (20), and tassels, if present, are shown by numeral 25, A logo portion 30 can be present, as can the pocket 35.

A preferred method of manufacturing the headpiece comprises:

1) providing a substantially rectangular piece of fabric, where the fabric may be a plurality of overlaying or partially overlaying pieces of fabric joined to one another by sewing, wherein preferably along one end of the rectangular piece there is an elastic band;
2) folding the rectangular fabric over on itself with one edge folded back to form a cylinder, and sewing the fabric along the joining seam;
3) cutting one end of the cylinder into long strips of fabric;
4) rolling or folding the other end of the cylinder (the end opposite where strips were cut) into an acceptable edge for the bottom part of the cap; and
5) optionally partially or fully pinching or closing the cylinder by sewing a seam perpendicular to the axis of the cylinder at a location at least 4 inches from the end forming the bottom part of the cap. As will be known in the art, reinforcing stitches can be added to the pattern before or after cutting to reduce fraying and the like. The flat strips can optionally be knotted at a point near the cap for ornamental reasons.

It is to be understood that the invention is not limited in its application to the details of construction and to the arrangements of the components set forth in the above description or illustrated in the drawings. The invention is capable of other embodiments and of being manufactured in various ways. As such, those skilled in the art will appreciate that the conception, upon which this disclosure is based, may readily be utilized as a basis for the designing of other structures, methods and systems for carrying out the several purposes of the present invention.

What is claimed:

1. A hair drying head-piece that absorbs moisture from the hair of a wearer, said headpiece comprising: A) a cap adapted to fit about the wearer's head and having a top part and a bottom part, said cap bottom part comprising an opening sized to fit about the top of the wearer's head and said cap top part having a hole therein to allow at least a portion of the wearer's hair to exit the cap therethrough; and B) at least 4 flat water-absorbing fabric strips attached to the cap top part and adapted to contact the wearer's hair, each of the 4 flat water-absorbing fabric strips having a length of between 12 and 30 inches and a width between 0.6 inches and 2 inches.

2. The hair drying head-piece of claim 1, wherein the at least 4 flat water-absorbing fabric strips are integral to the cap portion and extend out from the cap top part and then fall freely downward.

3. The hair drying head-piece of claim 1, wherein there are between 5 and 8 flat water-absorbing fabric strips.

4. The hair drying head-piece of claim 1, wherein there are between 9 and 12 flat water-absorbing fabric strips.

5. The hair drying head-piece of claim 1, wherein the opposite edges of at least 4 of the flat water-absorbing fabric strips are substantially parallel one to another.

6. The hair drying head-piece of claim 1, wherein the length of the at least 4 water-absorbing fabric strips is between 14 and 24 inches and the width of the at least 4 water-absorbing fabric strips is between 0.75 inches and 1.5 inches.

7. The hair drying head-piece of claim 1, wherein there is a small pocket disposed within the cap portion.

8. The hair drying head-piece of claim 1, further comprising at least one braided fabric or tassel extending from the cap.

9. The hair drying head-piece of claim 1, wherein the opposite edges of at least 4 of the flat water-absorbing fabric strips are substantially parallel one to another, wherein the width of a strip at the last inches of said strip furthest from the cap is tapered.

10. A hair drying head-piece that absorbs moisture from the hair of a wearer, said headpiece comprising: A) a cap adapted to fit about the wearer's head and having a top part and a bottom part, said cap bottom part comprising an opening sized to fit about the top of the wearer's head; and B) at least 4 flat water-absorbing fabric strips attached to the cap top part and adapted to contact the wearer's hair, each of the 4 flat water-absorbing fabric strips having a length of between 12 and 30 inches, a width between 0.6 inches and 2 inches, wherein the opposite edges of at least 4 flat water-absorbing fabric strips are substantially parallel one to another.

11. The hair drying head-piece of claim 10, wherein the at least 4 flat water-absorbing fabric strips are integral to the cap and extend out from the cap top part and then fall freely downward.

12. The hair drying head-piece of claim 10, wherein there are between 5 and 8 flat water-absorbing fabric strips.

13. The hair drying head-piece of claim 10, wherein there are between 9 and 12 flat water-absorbing fabric strips.

14. The hair drying head-piece of claim 10, wherein the opposite edges of at least 4 of the flat water-absorbing fabric strips are substantially parallel one to another.

15. The hair drying head-piece of claim 10, wherein the length of at least 4 of the water-absorbing fabric strips is between 14 and 24 inches and the width of at least 4 of the water-absorbing fabric strips is between 0.75 inches and 1.5 inches.

16. The hair drying head-piece of claim 10, wherein the cap top portion having a hole therein to allow at least a portion of the wearer's hair to exit the cap portion therethrough, said hole being defined by the top of the cap wherein the fabric strips start.

17. The hair drying head-piece of claim 10, further comprising at least one braided fabric or tassel extending from the cap.

* * * * *